United States Patent [19]

Carvalho et al.

[11] 4,160,360

[45] Jul. 10, 1979

[54] OPTICAL STRAND SENSOR FOR DETECTING A FILAMENT BEING WOUND AND TWISTED ON A SPOOL

[75] Inventors: Robert L. Carvalho; Sheldon A. Canfield, both of Newark; Gary Steinbaugh, St. Louisville, all of Ohio

[73] Assignee: Owens-Corning Fiberglas Corporation, Toledo, Ohio

[21] Appl. No.: 928,343

[22] Filed: Jul. 27, 1978

[51] Int. Cl.[2] ..... D01H 13/16

[52] U.S. Cl. ..... 57/81

[58] Field of Search ..... 57/80, 81, 78, 34 R; 250/561; 340/259

[56] References Cited

U.S. PATENT DOCUMENTS

| | | | |
|---|---|---|---|
| 3,158,852 | 11/1964 | Schacher | 57/81 X |
| 3,840,869 | 10/1974 | Pugh | 57/81 X |
| 3,772,524 | 11/1973 | Erbstein | 57/81 X |

*Primary Examiner*—John Petrakes

*Attorney, Agent, or Firm*—Ronald C. Hudgens; Charles F. Schroeder; Joel I. Rosenblatt

[57] ABSTRACT

A guide is placed between a strand of fibers and a winder, which twists the strand as it is wound. The guide is circular so the strand may be maintained in an unconstrained twisting path between the receiver and the supply as it is being wound and twisted and includes an optical sensor mounted about the area of movement of the filament to detect the presence of the filament and stop the winding process if the strand breaks.

25 Claims, 5 Drawing Figures

OPTICAL STRAND SENSOR FOR DETECTING A FILAMENT BEING WOUND AND TWISTED ON A SPOOL

FIELD OF THE INVENTION

This invention pertains to the field of winding and twisting strands of parallel filaments into twisted yarn and to the field of guiding any material as it is being wound and moved in a plurality of diverse directions, with the material maintained in a free twisting path in direction of primary movement.

BACKGROUND OF THE INVENTION

The winding of a strand of parallel filaments onto a spool with the result that it is twisted as it is wound has presented a problem in the detection of that strand during the process.

Several prior art devices for strand detection are as shown in U.S. Pat. Nos. 4,074,871, 3,751,893, 3,840,869 and 3,734,422. U.S. Pat. Nos. 4,074,871 and 3,651,893 shows the disadvantage of the prior art this invention overcomes by allowing the filament to be maintained in a straight line from supply to take-up spool. U.S. Pat. No. 3,734,422 shows a tribo electric yarn monitor in contact with the filament. U.S. Pat. No. 3,840,869 shows a photoelectric transducer requiring the free path of the yarn be altered.

In the prior art, a sensor to detect the presence of the strand and to stop the winding machinery if the strand broke usually required a physical contact between the sensor and the strand. This physical contact at least distorted the free twisting path described from the supply package to the wound package and impeded the flow of the twist back to the supply package. Optical sensors did not provide a satisfactory solution since the narrow filament moved simultaneously about the spool in a direction transverse to the primary winding direction and required additional optical masks and lenses to form a directed light beam or to shape the perceived light beam. Other sensors required the strand path be distorted to lead the filament past a sensor altering the filament path from the supply to the winding spool. A guide for detecting a filamentary material is also disclosed in copending application Ser. No. 940,068 filed Sept. 7, 1978 and assigned to the common assignee. It discloses a guide and detector sensing the presence of a filament moving in a straight line.

SUMMARY OF THE INVENTION

This invention is used to sense the presence of a filamentary material such as a strand as it is being wound from a supply package to spool, without physically contacting the strand and without distorting the free twisting path described by the strand at any time as it is being wound from said supply package to said wound package.

A strand being wound and twisted simultaneously moves transverse to the primary winding direction, and describes a cone with its apex at the supply package. It is of the greatest benefit in the winding process to have this cone undisturbed with its apex at the package, where the strand leaves the package. The benefit is that the twist can propogate back to the supply package.

As described above, and because of the transverse movement, the prior art required some type of physical contact with the strand, disturbing this cone by breaking the continuity of the free twisting path of the strand as it is being unwound from the supply package to the wound spool.

This invention overcomes this problem by providing a guide means which surrounds the strand but does not disturb the movement of the strand, as it proceeds from the package to the spool in the primary direction of winding or the movement of the strand in other directions transverse to the primary direction of movement as it is being wound around the spool. Typically such strand will describe a cone and the guide being circular surrounds the cone with its circumference being substantially that of the described cone at the point on the cone closest to the guide.

The optical sensor senses reflected light from the filament and has a region of maximum sensitivity at its area of focus. The sensor is placed on the guide with its region of maximum sensitivity substantially at the inner periphery of the guide closest to the sensor. The sensor has a light source, such as an LED, and a reflective light sensor, such as a photo darlington light sensing circuit. Reflected light from the strand to the photo darlington light sensor, as the strand moves through the circular guide means and about the inner periphery of the circular guide means, generates a Strand Presence Signal.

The cone described by the strand as it is being wound on the winding means is called a balloon. The advantage of this invention is that the balloon is allowed to propogate from the winding means through to the supply and is undisturbed and undistorted by the detecting means.

DESCRIPTION OF THE PREFERRED EMBODIMENT

Figure 1:
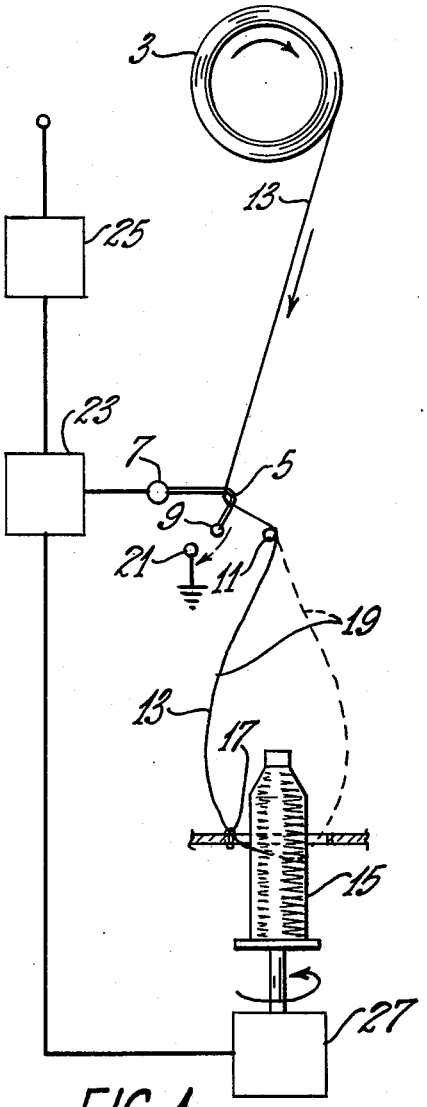
FIG. 1 describes the winding apparatus with the prior art method of detecting the presence of the strand.

The principles of the invention are now described with reference to the following drawings which show the means of the preferred embodiment but should not be viewed as restricting the inventions to the particular embodiment shown. Referring now to FIG. 1, the prior art method of detecting a filamentary material such as a strand and particularly a broken strand is shown generally by numeral 1 showing the strand supply package 3, a knock-off pin 5 having a pivot at 7 and a contact at 9, a fixed pin 11 guiding said strand to a means 15 for winding the strand and twisting the strand as it is being wound, and a means 17 for guiding the strand in its travel from fixed pin 11 to the means for winding 15. As is shown in the prior art, the movement of the strand as it is being wound from fixed pin 11 through to the means for winding 15 describes a cone as shown by the dotted lines 19 as the strand moves in the direction across the plane of the guide 17, the strand 13 being shown at one particular moment in the winding process.

The apparatus used to detect the presence of the strand—in particular the moment when the strand breaks—is shown as including the knock-off pin 5 having contact 9 pivotally mounted at 7, contact 21 connected to ground, detector 23, and power supply 25.

As can be seen from FIG. 1, a broken strand will permit the knock-off pin 5 to rotate clockwise so that contact 9 connects with contact 21, closing the circuit to ground and energizing the detecting circuit 23 by completing a path for the power supply 25 to ground. A control line 20 is connected between detecting circuit 23 and the winder driver 27. When a strand breaks, the knock-off pin 5 will rotate, closing the contact 21 and completing the path to ground for power supply 25 through the detecting means 23 which controls the power to motor 27 and stops the winder.

As can be seen from the prior art description, the free twist path 13 is curved between the means for winding 15 and the supply package 13. Particularly, it describes a cone 19 often called a Balloon between the means for winding and the fixed pin 11. The strand is forced to go through a curved route, distorting and shortening the cone shaped balloon 19.

Figure 2:
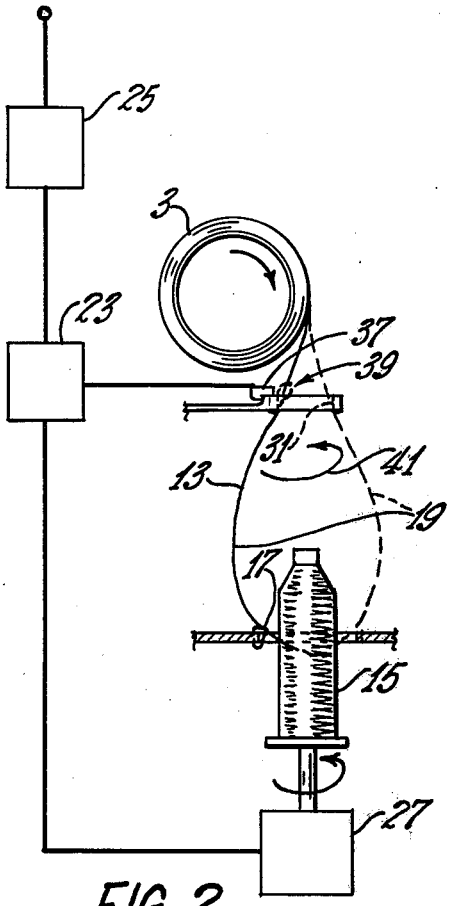
FIG. 2 describes the preferred embodiment of this apparatus according to the principles of this invention, showing the guide means and light sensor with the winder apparatus.

Referring now to FIG. 2 the principles of this invention are shown with reference to the preferred embodiment, with the same numerals used to describe the same and similar functioning parts as in FIG. 1.

A means for winding 15 is shown for collecting the filamentary material such as a strand 13 as it is pulled from the supply package 3. As is common in the winding process, the axis of the means for winding 15 is substantially in the direction of the principal movement of the strand from package 13 to means for winding 15 and the strand comprising parallel strands of monofilament fiber is twisted as it is wound on the means for winding 15.

The strand 13 describes a cone 19 as it is being wound, moving about the inner periphery 31 of the means for guiding 33. A means for sensing 37 is placed outside said means for guiding and detects the presence of the strand as it moves through its path within the means for guiding 33 and as it is drawn from the package 3 to the winder 15. A detector 23 is provided connected to the means for sensing 37. The sensor 37 is an optical sensor which has its region of greater sensitivity substantially at the inner periphery of the means for guiding and at that portion of the inner periphery closest to the sensor shown as numeral 39. The strand moves in either the direction of arrow 41 or the opposite direction as it also moves in its principal direction toward the means for winding 15 and passes the sensor 37 and particularly the region of greater sensitivity 39 of the sensor 37 as it is being withdrawn from supply package 3 to the winder 15. The means for sensing then detects the presence of the strand as it is being moved and wound and maintains current to the drive motor 27 from the detector 23. Upon failure of the winding process wherein the strand breaks, the strand 13 will cease to move within the direction of arrow 41, or an opposite direction where the spool winding means 15 is wound in the opposite direction, causing the detecting mechanism 23 to disconnect power from the motor 27 and stop the process.

Figure 3:
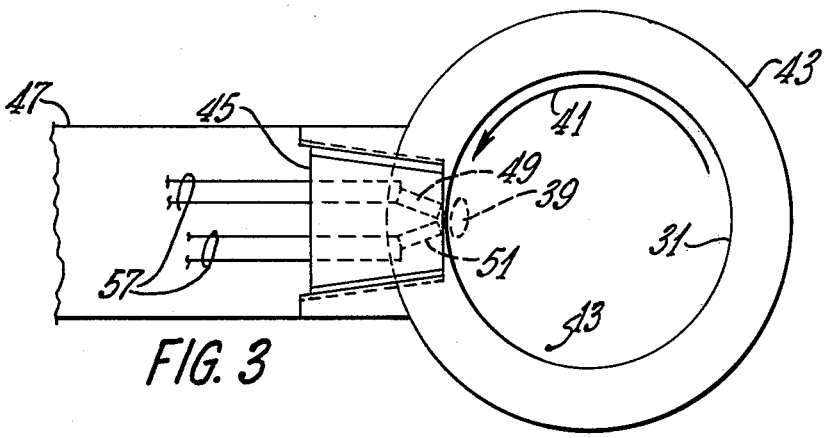
FIG. 3 is a top view of the means for guiding, showing the light sensor with its area of focus substantially at the inner periphery of the means for guiding.
Figure 4:
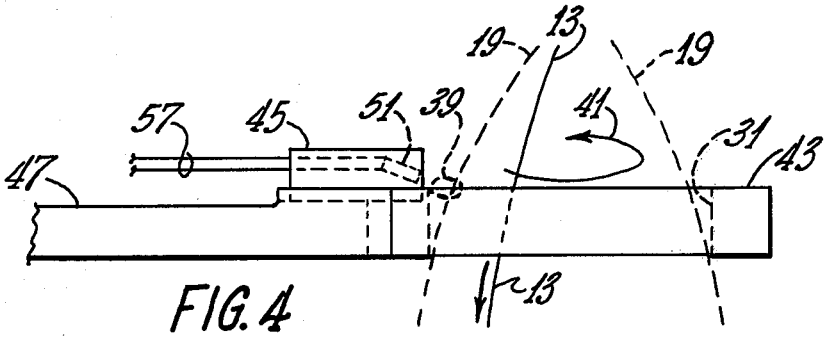
FIG. 4 shows a side view of the sensor as shown in FIG. 3.

Referring now to FIG. 3, the means for guiding is shown in a top view as numeral 43, with the principal direction of the strand being wound from the means for supply to the winding means through the plane of the paper. A means for sensing 45 is shown being mounted on the guide support 47. The means for sensing 45 has a light source 49 and a reflected light sensor 51. The light source and the light sensor is focused at region 39 substantially at the inner periphery 31 of the guide and at that region of the inner periphery closest to the sensor. Although not shown in the drawing, an adjustable mounting may be used so that the sensor can be adjusted in place. Connecting wires 57 for connection to the detector 23 are provided and for supplying the power to the sensor. Referring now to FIG. 4 the sensor is shown in a side view with the same parts as shown in FIG. 3 described by the same numerals. The light source 49 is shown having its principal focus at region 39 being at the inner periphery of the means for guiding and mounted within sensor body 45.

Movement of the strand 13 is in the direction of arrow 41 or the opposite direction as it is being simultaneously moved from the means for supply 3 to the winding means 15 in the principal direction through the plane of the drawing. The movement of the strand in a direction transverse to its principal direction of movement from the means for supplying the strand to the means for winding, describes a cone or a balloon indicated by numeral 19. The sensor has its focus or region of greater sensitivity substantially at the periphery of the guide so that its light beam is intercepted by the strand as it moves in the direction of arrow 41 around the periphery of the guide and the light reflected from the strand is then received by the reflected light sensor 51 of the sensor body 45 and a suitable signal is transmitted to detector 23 indicating that the strand is being wound on the means for winding.

If a break occurs in the strand, then the movement of strand 13 will not intercept the light beam from the sensor 45. A suitable signal is then sent to detector 23 which causes the winding process to stop.

In accordance with known art, the detector 23 may be connected to a clock or timing mechanism so that detection of reflected light by the reflected light sensor portion of sensor 45 will cause the detector to maintain power to the motor during a predetermined period of non-detection of the reflected light from the strand as it is being moved around direction of arrow 41. After said predetermined time if a pulse from the reflected light sensor is not received, the detector 23 will perceive a strand break and stop power to the motor and stop the winding process. Detector 23 can be a count-down clock issuing a strand presence signal until it counts to zero when it issues a strand absence signal; it is reset to a predetermined count by a signal from the reflected light sensor monitoring the strand presence signal output as long as reflected light from the strand is sensed before the counter counts to zero.

A sensor which could be used in this device is commercially available from Optron Corp.

Figure 5:
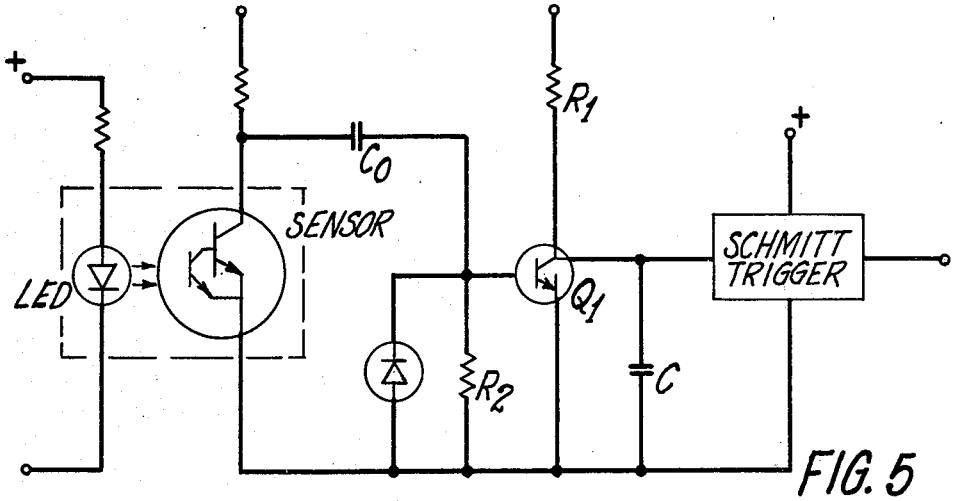
FIG. 5 shows a schematic of a particular timer which can be used with this invention.

A particular timer circuit which may be used with this invention is shown in FIG. 5.

FIG. 5 shows a particular controller which may be used with this invention. The unit within the dashed lines is the optical sensor consisting of the LED (light emitting diode) and the reflected light sensor. An 82 ohm resistor is shown in series with the power supply to provide 40 ma constant current source to the LED. Reflection of light by the strand causes a signal to be produced in the sensor and a pulse input to $Q_1$ turning $Q_1$ on and discharging C. In the absence of a signal from the sensor, C charges, as $Q_1$ is in its Off state. After a time period regulated by the charge time constant RC, C reaches the threshold voltage of the Schmitt Trigger, switching its output from a strand presence signal to a strand absence signal.

The embodiment shown here is exemplary of the invention but should not be construed to limit the principles of the invention to the particular structure shown and described.

I claim:

1. An apparatus for detecting a continuous filamentary material comprising a means for guiding said filamentary material placed in the path of the material, a supply for said material, a means for twisting and collecting said material as it is removed from said supply, the path of said material from said supply being substantially a free twist path to said means for collecting said material, said apparatus having a sensor mounted for detecting the presence of the material in the path defined by said supply, collecting means and said guide means.

2. The apparatus of claim 1 wherein said means for guiding has a side opposite said supply and said sensor is mounted on said opposite side.

3. The apparatus of claim 1 wherein said sensor is mounted on said guiding means on the supply side of the guiding means.

4. The apparatus of claim 1 wherein said sensor is an optical sensor having a light source and a sensor portion mounted to receive light reflected from the material.

5. The apparatus of claim 4 wherein said material describes a cone as it is being wound and twisted, said cone having its apex at said supply end.

6. The apparatus of claim 5 wherein said cone described by said material passes through said means for guiding said material.

7. The apparatus of claim 6 wherein said means for guiding is a body having an opening substantially circumscribing the path of said material as it moves transverse to its principal direction of movement from the supply to the means for collecting the material.

8. The apparatus of claim 7 wherein said sensor has a region of maximum sensitivity, said sensor being located with its region of maximum sensitivity substantially at a surface of said guide.

9. The apparatus of claim 3 wherein said sensor light source and reflected light sensor is focused at the inner surface of said means for guiding.

10. The apparatus of claim 9 wherein said means for guiding describes a plane and with the axis of said cone being substantially perpendicular to said plane.

11. The apparatus of claim 1 wherein said means for guiding is a body having an opening and said material passes through said opening.

12. An apparatus for detecting a continuous material comprising a means for guiding said material displaced in the path of the material, a supply for said material, a means for twisting said collecting said material as it is removed from said supply, the path of said material from said supply through said guide means being substantially a free twist path to said means for collecting said material, said means for guiding having means for mounting a sensor, a sensor mounted on said means for guiding for detecting the presence of the strand, and said means for guiding has a side opposite said supply and said sensor is mounted on said opposite side.

13. An apparatus for detecting a continuous filament comprising a means for guiding said filament displaced in the path of the material, a supply for said material, a means for twisting said collecting said material as it is removed from said supply, the path of said material from said supply through said guide means being substantially a free twist path to said means for collecting said material said means for guiding having means for mounting a sensor, a sensor, mounted on said means for guiding, for detecting the presence of the material, and wherein said sensor is mounted on said guiding means on the supply side of the guiding means.

14. An apparatus for detecting a continuous filamentary material comprising a means for guiding the filamentary material placed in the path of the material, a supply for the said material, a means for twisting and collecting said material is it is removed from said supply, the path of said material from said supply being substantially a free twist path to the said means for collecting said material, said apparatus having a sensor mounted for detecting the presence of the material in the path defined by the supply, collecting and guiding means, said sensor being an optical sensor having a light source and a sensor portion mounted to receive light reflected from the material and wherein said means for guiding is a body having an opening substantially circumscribing the path of the said material as it is being twisted and wound from said supply means.

15. The apparatus of claim 14 wherein the said material describes a cone as it is being wound and twisted, and said cone has its apex at the supply end.

16. The apparatus of claim 14 wherein the said sensor has a region of maximum sensitivity, said sensor being located with its region of maximum sensitivity substantially at a surface of said guide.

17. The apparatus of claim 16 wherein said material describes a cone as it is being wound and twisted, said cone having its apex at its supply end.

18. The apparatus of claim 17 wherein said cone described by said material passes through said means for guiding said material.

19. The apparatus of claim 18 wherein said means for guiding describes a plane and with the axis of said cone being substantially perpendicular to said plane.

20. An apparatus for detecting a continuous filamentary material comprising a means for guiding said filementary material placed in the path of the material, a supply for said material, a means for twisting and collecting said material as it is removed from said supply, the path of said material from said supply being substantially a free twist path to said means for collecting said material, said apparatus having a sensor mounted for detecting the presence of the material, said means for guiding being a body having an opening, with said material passing through said opening, said sensor being located on said guide and having a region of greatest sensitivity, said sensor being located with its region of greatest sensitivity substantially at the inner surface of said guide.

21. The apparatus of claim 20 wherein said opening is substantially circular.

22. The apparatus of claim 20 wherein said sensor has a light source and a reflected light sensor and is focused at said inner surface.

23. The apparatus of claim 22 wherein said light source is a light-emitting diode.

24. The apparatus of claim 32 wherein said filament passing through said guide describes a cone as it is being wound and twisted with the cone having its apex at said supply.

25. The apparatus of claim 22 wherein said circular opening of said means for guiding describes a plane with the axis of said cone being substantially perpendicular to said plane.

* * * * *